US010253987B2

(12) United States Patent
Armstrong

(10) Patent No.: US 10,253,987 B2
(45) Date of Patent: Apr. 9, 2019

(54) OVEN DOOR SPILL DIVERTER SYSTEM

(71) Applicant: Haier US Appliance Solutions, Inc., Wilmington, DE (US)

(72) Inventor: James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

(21) Appl. No.: 15/661,025

(22) Filed: Jul. 27, 2017

(65) Prior Publication Data

US 2019/0032924 A1 Jan. 31, 2019

(51) Int. Cl.
*F24C 15/02* (2006.01)
*F24C 15/14* (2006.01)

(52) U.S. Cl.
CPC ..... *F24C 15/028* (2013.01); *F24C 15/14* (2013.01)

(58) Field of Classification Search
CPC ..... F24C 15/14; F24C 15/028; F24C 15/006; F24C 15/04; F24C 15/021
See application file for complete search history.

(56) References Cited

U.S. PATENT DOCUMENTS 7,847,219 B2 * 12/2010 Kim ..... F24C 15/04 126/198
2008/0105140 A1 * 5/2008 Lee ..... F24C 15/006 99/468
2016/0010874 A1 1/2016 Phillips et al.

FOREIGN PATENT DOCUMENTS

WO WO2012089460 A1 7/2012

* cited by examiner

*Primary Examiner* — Alfred Basichas
(74) *Attorney, Agent, or Firm* — Dority & Manning, P.A.

(57) ABSTRACT

An over door spill diverter system for the routing of liquid entering an oven door at or near its top. Liquid is diverted away from the window to prevent stains on the inside surface that a user may not be able to readily clean or otherwise remove. The diverter system also allows for convective air flow through the oven door to properly cool the exterior of the door. A variety of oven door constructions may be utilized.

18 Claims, 10 Drawing Sheets

OVEN DOOR SPILL DIVERTER SYSTEM

FIELD OF THE INVENTION

The subject matter of the present disclosure relates generally to a spill diverter system for an oven appliance.

BACKGROUND OF THE INVENTION

Oven appliances typically include a door that a user can open and close to access the cooking chamber where food items are placed for cooking. The door may include a window whereby the user can observe the contents of the cooking chamber to e.g., monitor cooking operations when the door is closed. The door may be constructed from e.g., one or more metals such as stainless steel and may include a coating for aesthetics and protection.

In certain conventional constructions, the door is constructed to maintain a substantial temperature difference between the exterior of the oven appliance and the cooking chamber where temperatures may exceed 500° F. Insulation may be included between the interior surface of the door and the exterior surface. Additionally, one or more ventilation ports may be provided to create a convective air flow through the interior of the door to cool exterior surfaces. For example, the ventilation ports may allow cool air to enter the bottom of the oven door and then, as the air is heated, flow vertically upward through the door and exit at or near the top of the door.

The oven may be included within a range type of appliance where a cooktop is provided with one or more locations to provide heat for a pot or pan in which food items will be cooked. The cooktop surface is above the oven including the oven door. During cooking operations, a user may spill liquids onto the cooktop surface. Depending on the volume of the spill, liquid may flow off the cooktop surface. If the liquid flows toward the door, the liquid may eventually flow into the inside of the door through e.g., the ventilation ports or gaps near the top of the door. The liquid may eventually reach the window in the oven door. Depending on the contents of the liquid, the window may be left with a stain or residue along an inside surface thereby obscuring the user's view and providing an undesirable appearance. Such inside surface is typically inaccessible to the user of the appliance and, therefore, cannot be readily removed by cleaning.

Accordingly, an oven door with features for diverting a liquid spill away from the window would be useful. Such an oven door that still allows for adequate ventilation of the over door to provide cooling of the exterior surface would be particularly beneficial.

BRIEF DESCRIPTION OF THE INVENTION

The present invention provides for the diversion of liquid entering an oven door at or near its top. Liquid is diverted away from the window to prevent stains on the inside surface that a user may not be able to readily clean or otherwise remove. At the same time, the present invention allows for convective air flow through the oven door to cool the exterior of the door. A variety of oven door constructions may be used with the present invention. Additional aspects and advantages of the invention will be set forth in part in the following description, or may be apparent from the description, or may be learned through practice of the invention.

In one exemplary embodiment, a door for an oven appliance is provided. The door defines vertical, lateral, and transverse directions. The door includes an exterior wall and an interior wall. The exterior wall and interior wall extends along the vertical direction between a top portion and a bottom portion of the door and extend along the lateral direction between opposing lateral sides of the door. A cavity is defined at least in part by the exterior wall and the interior wall and located therebetween. Ventilation ports are positioned near the top of portion of the door.

For this embodiment, a first diverter is positioned within the cavity below the ventilation ports and adjacent to the exterior wall. The first diverter includes a first trough extending longitudinally at a non-zero angle from the lateral direction so as to cause liquid to flow towards at least one of the opposing lateral sides of the door. A deflector is positioned within the cavity adjacent to the ventilation ports and above the first trough. The deflector is spaced apart along the transverse direction from the exterior wall. The deflector has a lip angled towards the exterior wall so as to cause liquid to flow towards the exterior wall. A second diverter is positioned within the cavity below the ventilation ports and adjacent to the interior wall. The second diverter includes a second trough extending longitudinally at a non-zero angle from the lateral direction so as to cause liquid to flow towards at least one of the opposing lateral sides of the door.

In another exemplary embodiment, an oven appliance is provided that includes a cook top surface having one or more heating elements positioned at the cook top surface. A user interface panel is positioned at the cook top surface. An oven cavity provides for receipt of food items for cooking, the oven cavity positioned below the cook top surface. A door defines vertical, lateral, and transverse directions and controls access to the oven cavity. The door includes an exterior wall and an interior wall spaced apart from each other along the transverse direction, the exterior wall defining ventilation ports positioned near a top portion of the door.

In this embodiment, a first diverter is positioned below the ventilation ports and adjacent to the exterior wall, the first diverter including a first trough extending longitudinally at a non-zero angle from the lateral direction so as to cause liquid to flow towards at least one of the opposing lateral sides of the door. A deflector is positioned adjacent to the ventilation ports and above the first trough. The deflector is spaced apart along the transverse direction from the exterior wall and has a lip angled towards the exterior wall so as to cause liquid to flow towards the exterior wall. A second diverter is located within the cavity below the ventilation ports and adjacent to the interior wall. The second diverter includes a second trough extending at a non-zero angle from the lateral direction so as to cause liquid to flow towards at least one of the opposing lateral sides of the door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in the figures denotes the same or similar features.

DETAILED DESCRIPTION OF THE INVENTION

Figure 1:
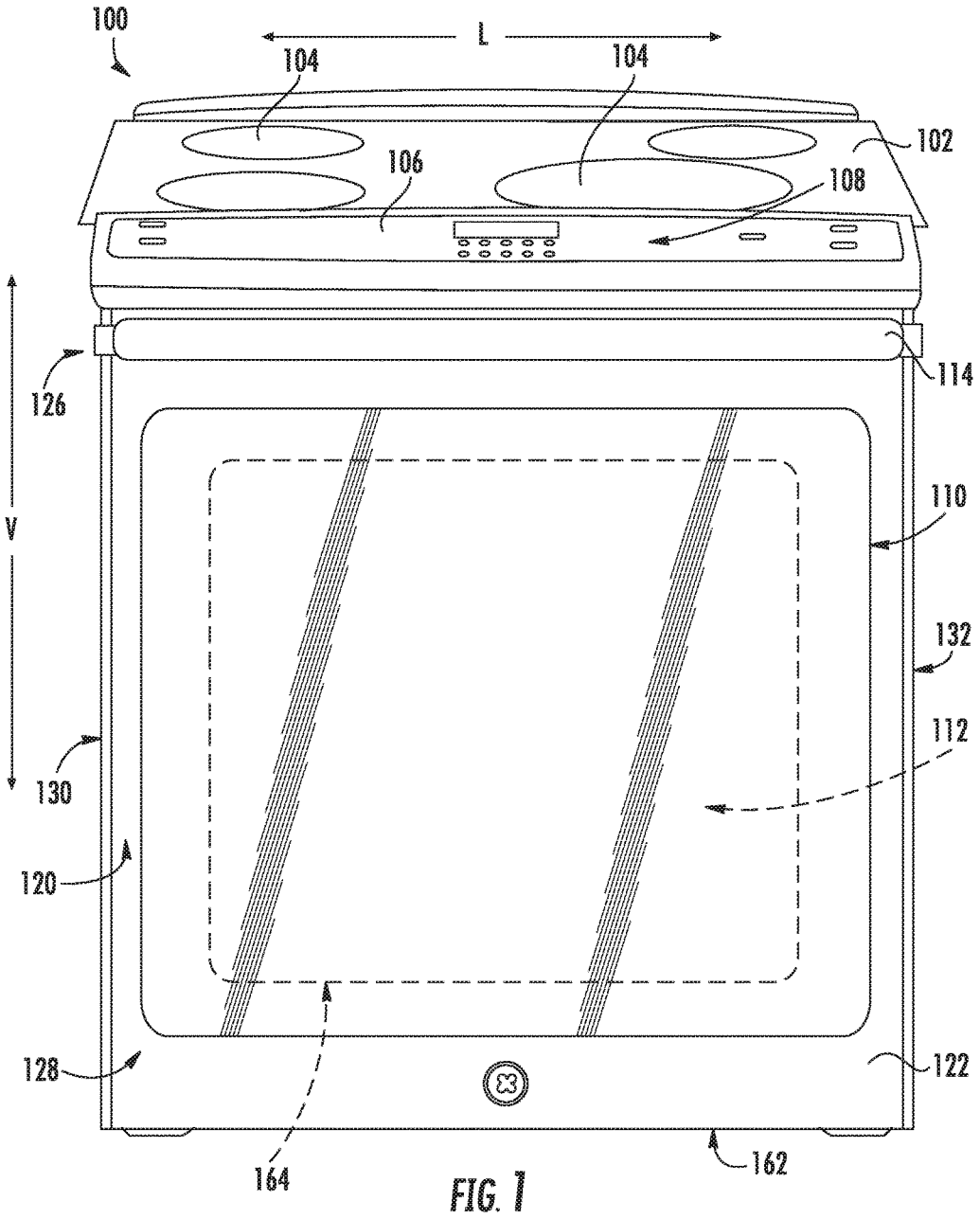
FIG. 1 is a front view of an exemplary embodiment of an oven appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
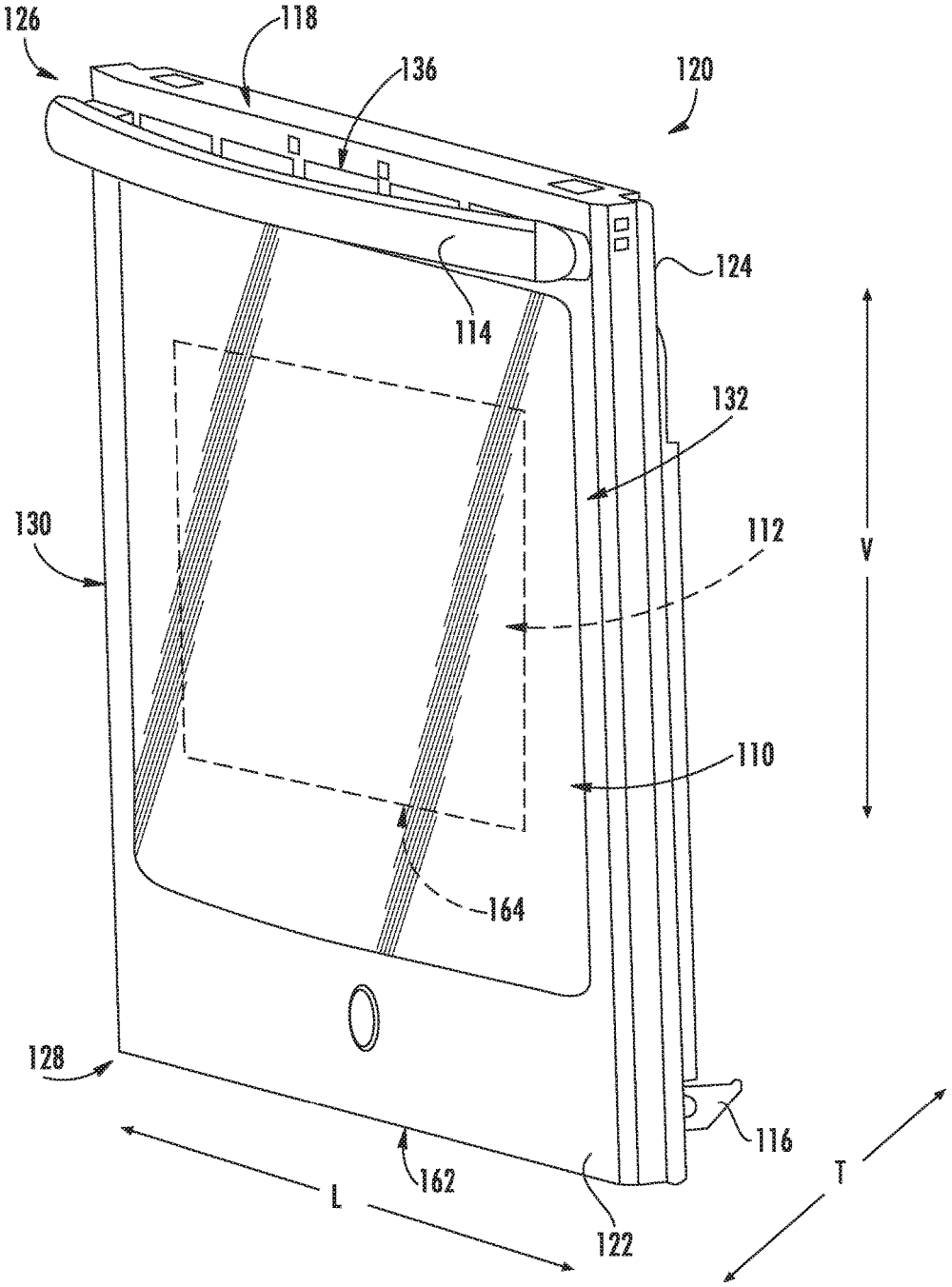
FIG. 2 is a perspective view of an exemplary embodiment of an oven door of the present invention.

FIG. 1 provides a front view of an exemplary oven appliance 100 of the present invention while FIG. 2 depicts a perspective view of an exemplary door 120 used therewith. Oven 100 with door 120 defines a vertical direction V, lateral direction L, and transverse direction T that are each orthogonal to the others and are used in describing embodiments of the invention herein.

Oven 100 is shown as a range type appliance having a cook top surface 102 positioned over an oven cavity 112. Cook top surface 102 includes a plurality of heating elements 104 on which e.g., pots, pans, other utensils may be placed for cooking operations including heating, frying, and boiling. By way of example, gas or electric powered heating elements may be used. Oven cavity 112 provides an interior space into which food may be placed for cooking operations including e.g., baking and broiling. A user interface panel 106 includes various controls 108 for selecting e.g., the power settings of heating elements 104, the temperature of cooking operations in oven cavity 112, the mode of cooking operations in oven cavity 112, and other operations of oven 100. A door 120 allows a user to selectively open and close access to oven cavity 112.

The present invention is not limited to the particular oven appliance configuration shown in the figures and other oven types and constructions may be used as well. For example, an oven having multiple doors and oven cavities, wall ovens, and other types of oven appliances may be also be used.

By way of example, during cooking operations, a user may spill liquid onto cook top surface 102. Depending on the amount of liquid and location of the spill, the liquid may travel from surface 102 onto a top portion 126 of door 120 and into door 120 through ventilation ports 136 or cracks along top side 118. If liquid flows onto glass in front window 110 within the interior of door 120, a user may not be able to remove the liquid or otherwise clean the glass, eventually resulting in an undesirable stain. As will now be described, oven 100 is equipped with a door 120 having features that provide protection against spills that enter into the interior of door 120.

Figure 3:
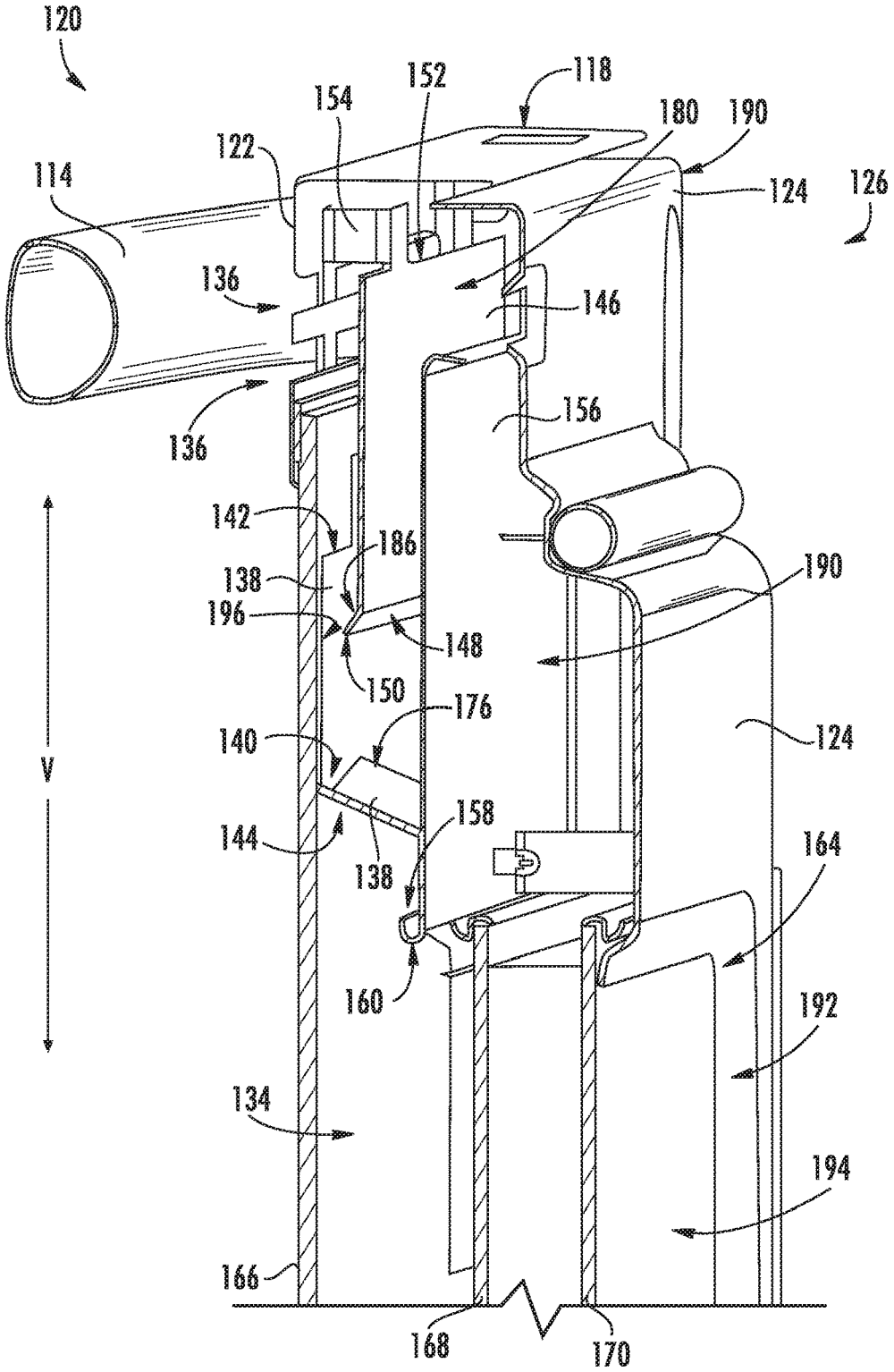
FIG. 3 is a cross-sectional view of the exemplary oven door of FIG. 2.
Figure 4:
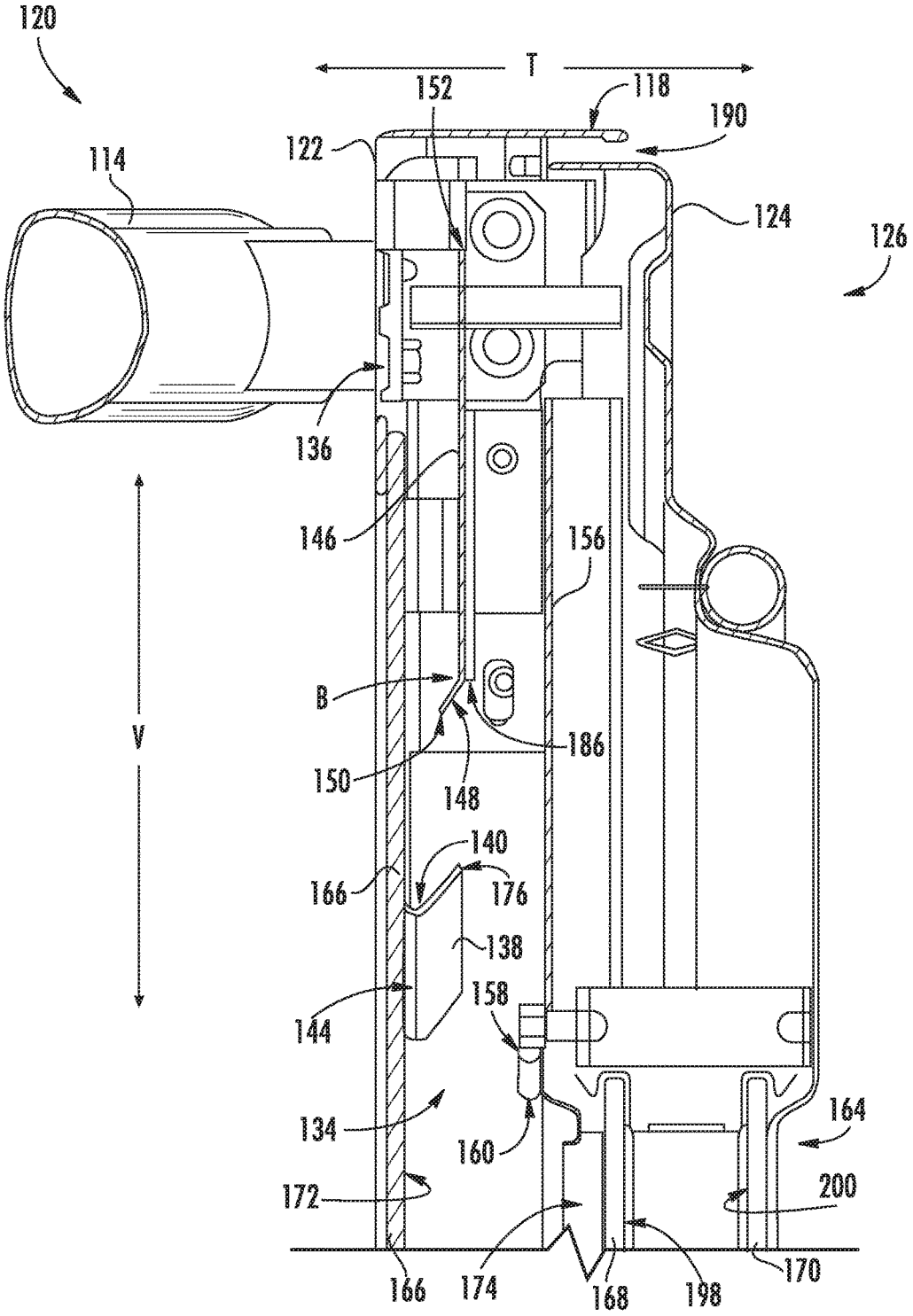
FIG. 4 is a side, cross-sectional view of the exemplary oven door of FIG. 2.

Referring now to FIGS. 2, 3 and 4, oven door 100 includes an exterior wall 122 and an interior wall 124, which faces oven cavity 112. Each wall 122 and 124 may be constructed from multiple components is not limited to e.g., a single sheet of metal. For example, walls 122 and 124 may each be constructed from one more plates or portions and have different shapes and configurations from what is illustrated in the figures. Walls 122 and 124 each extend along vertical direction V between a top portion 126 and a bottom portion 128 of door 100, and each extend along lateral direction L between opposing lateral sides 130 and 132 of door 100.

Walls 122 and 124 are spaced apart along transverse direction T so as form at least part of an interior or cavity 134. A plurality of ventilation ports 138 are positioned on wall 122 at top portion 126 of door 120. During cooking operations, air can enter door 120 through ventilation ports (not shown) at the bottom side 162 and travel vertically upward through convective currents and exit through ventilation ports 138. This flow of air helps cool door 120, which may be touched by a user and may have paint or other coatings on exterior wall 122 that could be damaged if the temperature is too high. Accordingly, the present invention allows for protection against liquids that enter door cavity 134 while also allowing for proper ventilation to occur.

Figure 5:
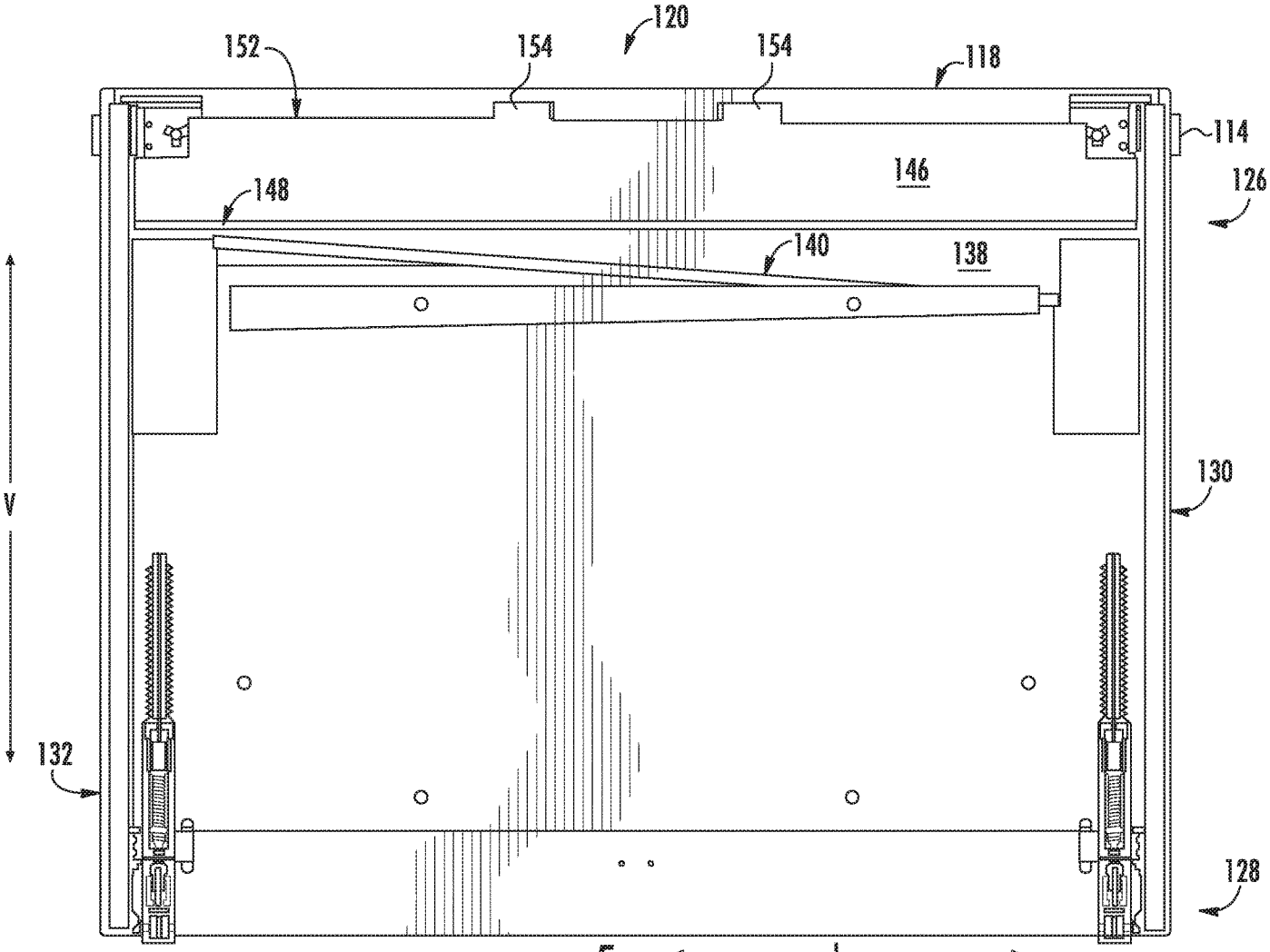
FIG. 5 is a rear view of the exemplary oven door of FIG. 2 with an interior wall removed for purposes of illustration.
Figure 6:
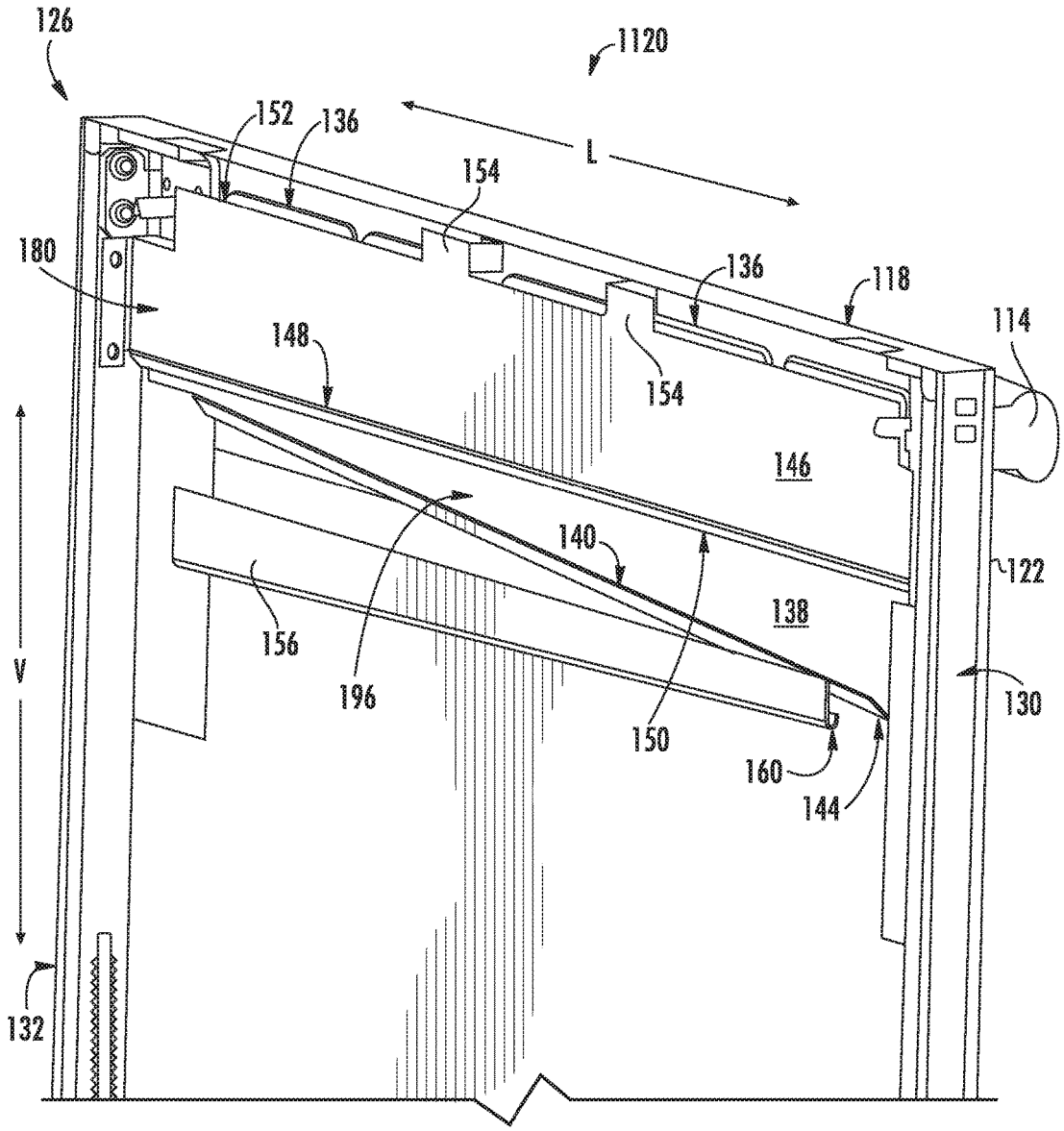
FIG. 6 is a rear view along one side of the exemplary oven door of FIG. 2 with an interior wall removed for purposes of illustration.
Figure 7:
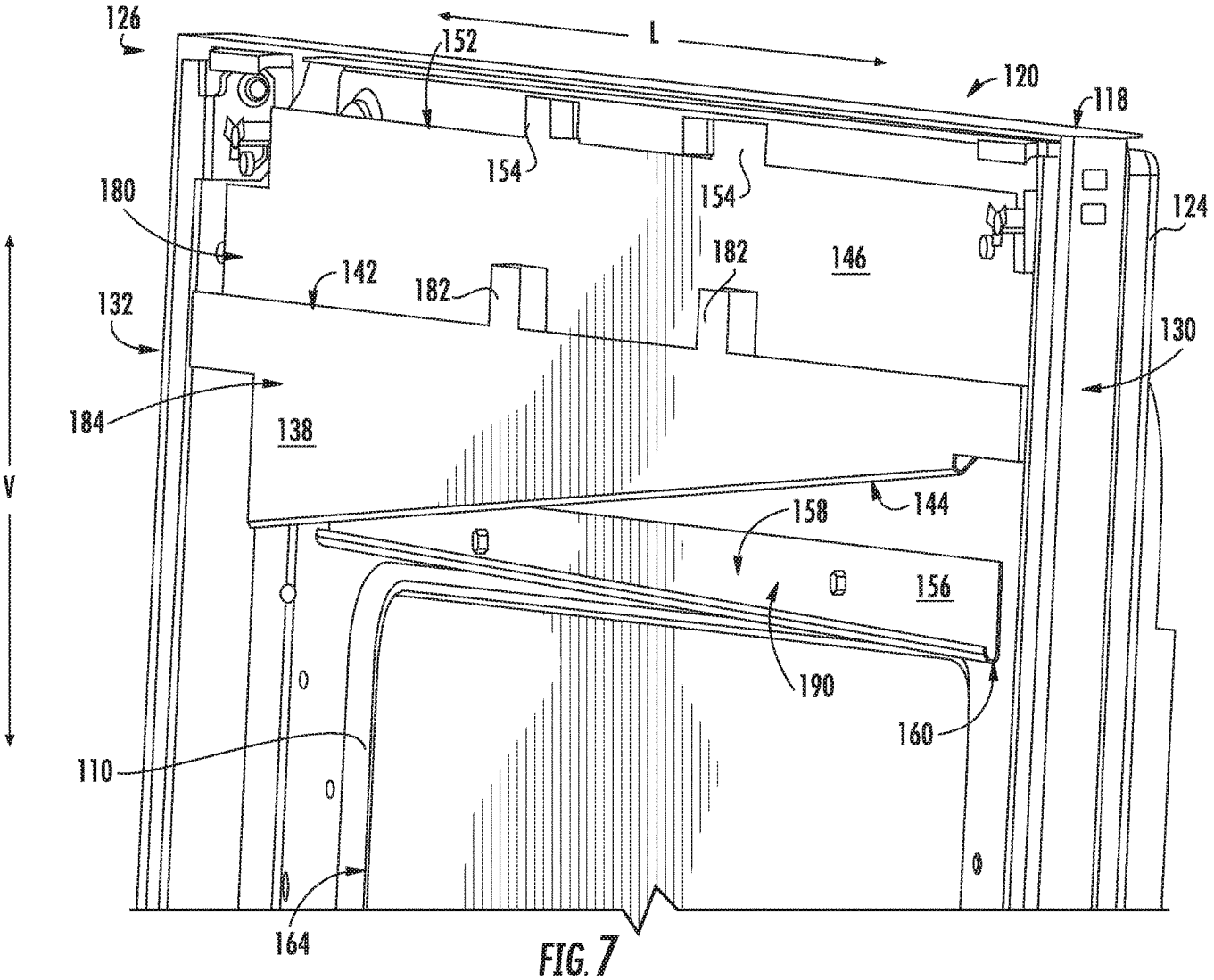
FIG. 7 is a front view along one side of the exemplary oven door of FIG. 2 with an exterior wall removed for purposes of illustration.

Referring now to FIGS. 3 through 9, a first diverter 138 is positioned within cavity 134. For this exemplary embodiment, first diverter 138 is attached directly to exterior wall 122 using e.g., posts 182, but other means of support may be used as well. First diverter 138 has a main body portion 184 (FIG. 7) that, for this embodiment, is parallel to vertical direction V and exterior wall 122. First diverter 138 has a top edge 142 that is located vertically below ventilation ports 136 so as to avoid blocking the flow of air therethrough and to allow liquids to pass into cavity 134 through ventilation ports 136. Additionally, main body 184 is placed onto exterior wall 122 so that liquid entering through e.g., ventilation ports 136 will flow onto the interior facing side 196 (FIGS. 3 and 6).

First diverter 138 includes a first trough 140 also positioned below ventilation ports 136 but above the see-through portion 164 of front window 110 on exterior wall 122. More particularly, for this embodiment, three panes 166, 168, and 170 are supported by door 120 and positioned at window 110. Front window 110 and rear window 192 includes a see-through portion 164 that extends through panes 166, 168, and 170 by which a user can see into oven cavity 112. For this exemplary embodiment, first trough 140 is located above see-through portion 164 along vertical direction V so as to prevent liquids from travelling downward onto e.g., the interior surfaces 172, 174, 198, or 200 of panes 166, 168, and 170 (FIG. 4). First diverter 138 can be constructed from e.g., a metal sheet having a bend 144 along the bottom edge that forms first trough 164 from an acute angle between main body portion 184 and first diverter leg 176, which in turn points toward interior wall 124.

Figure 8:
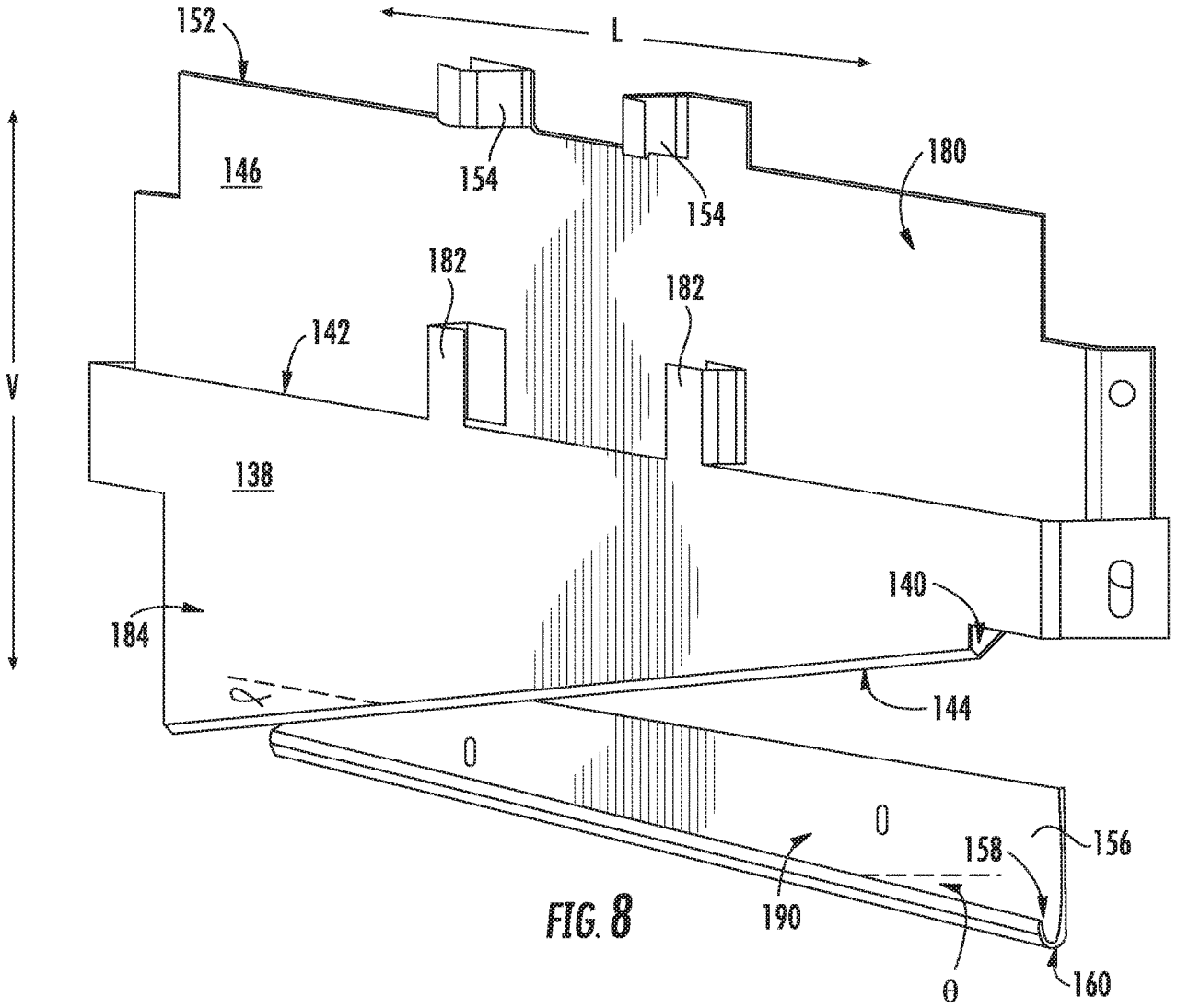
FIG. 8 is a front view along one side of exemplary diverters and an exemplary deflector shown as such would be positioned within the oven door of FIG. 2 and with all other parts of the door removed for purposes of illustration.
Figure 9:
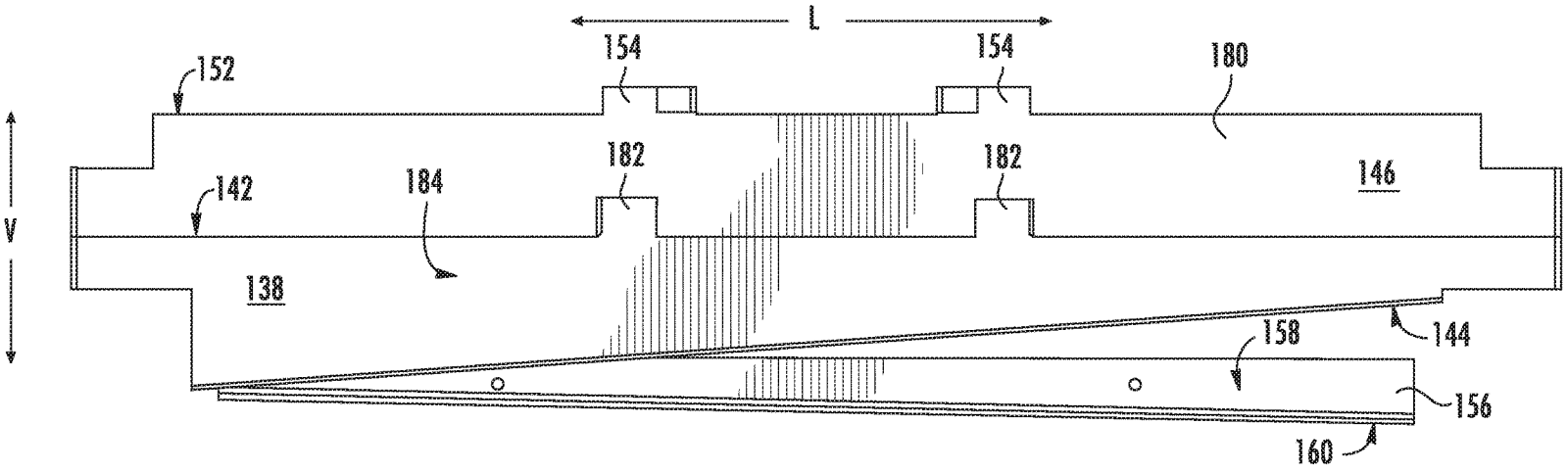
FIG. 9 is a front view of exemplary diverters and an exemplary deflector shown as such would be positioned within the oven door of FIG. 2 and with all other parts of the door removed for purposes of illustration.
Figure 10:
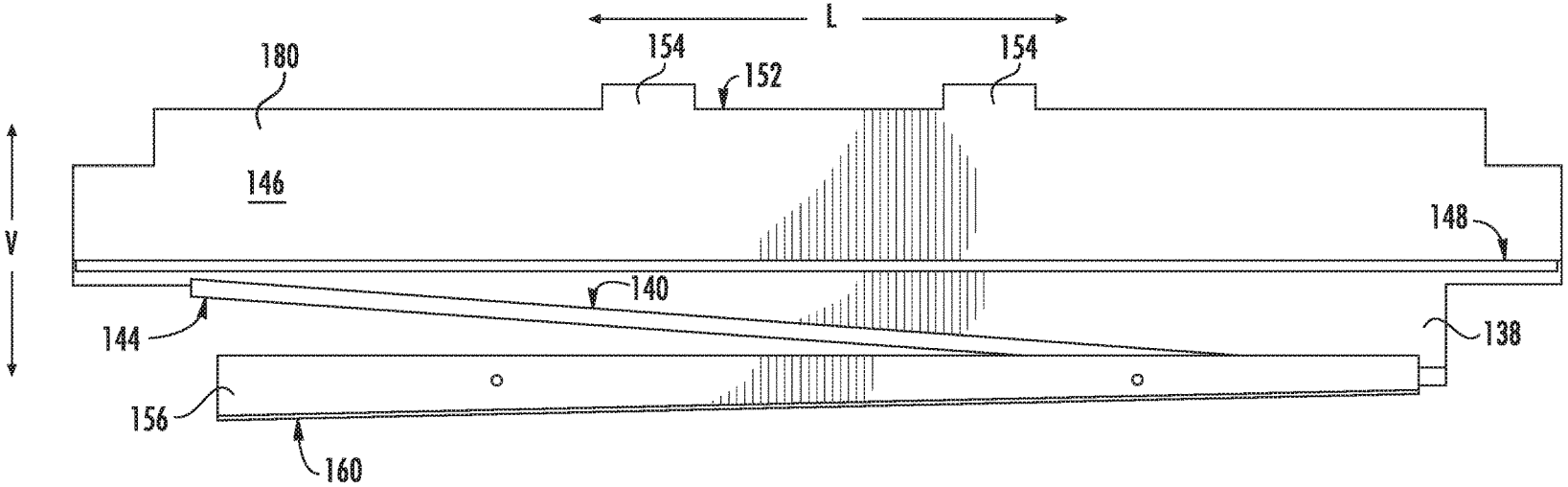
FIG. 10 is a rear view of exemplary diverters and an exemplary deflector shown as such would be positioned within the oven door of FIG. 2 and with all other parts of the door removed for purposes of illustration.

As depicted in FIG. 8, first trough 164 extends longitudinally at a non-zero, acute angle α from lateral direction L (i.e. from horizontal) so as to cause liquid in first trough 164 to flow towards side 130 of door 120. Other angles different from that depicted in the figures may be used and liquid could also be caused to flow towards opposing side 132. In other embodiments, first trough 164 could have one portion angled so that liquid flows towards one side 130 while another portion is angled to that liquid flows to the other side 132. Other constructions including a zero angle may be used provided liquid is directed away from the see-through portion 164 of window 110.

Door 120 includes a deflector 146 that is positioned within cavity 134 adjacent to ventilation ports 136 along transverse direction T (FIG. 4). Deflector 146 is positioned so that it deflects towards first diverter 138 any liquids entering cavity 134 through e.g., ventilation ports 146. For this embodiment, deflector 146 is spaced slightly away from exterior wall 122 along transverse direction T. Deflector 146 has a top edge 152 that may be located at least at the same height or higher as ventilation ports 136 for this embodiment so that liquid entering door cavity 134 through e.g., ventilation ports 136 at a velocity that might overshoot first diverter 138 is deflected back along transverse direction T towards first diverter 138.

Deflector 146 is attached to exterior wall 122 using posts 154 (FIG. 9), but other configurations for support may be used as well. Deflector 146 has a main body portion 180 that, for this embodiment, is parallel to vertical direction V and exterior wall 122. Deflector 146 has a lip 148 that is positioned above first trough 140 so that liquid may be directed towards first diverter 138 and captured by first trough 140 as the liquid travels vertically downward. Deflector 146 can be constructed from a metal sheet having a bend 186 along the bottom edge that forms a lip 148 that is angled towards exterior wall 122 so as to form an obtuse angle (FIG. 4) between main body portion 180 and lip 148, which in turn points toward exterior wall 122. Lip 148 has a lip edge 150.

As shown in FIG. 5, lip 148 and lip edge 150 are parallel to the lateral direction L or horizontal. However, in other embodiments, lip 148 or lip 150 may be at various angles provided such are above first trough 140 so as to be able to direct liquid into it.

Oven door 120 includes a second diverter 156 that is positioned within cavity 112. Second diverter 156 is positioned nearer interior wall 124 than first diverter 138 and deflector 146. Second diverter 156 can be spaced slightly away from interior wall 124 along transverse direction T or may adjacent thereto. Second diverter 156 may be supported on interior wall 124 other constructions may be used as well. For this embodiment, second diverter 156 has a main body portion 190 (FIG. 3) that is parallel to vertical direction V and exterior wall 122.

Second diverter 156 includes a second trough 158 that is positioned vertically below ventilation ports 136 and vertically below top side 118 of door 120. Second trough 158 is positioned to capture liquid that may enter door 120 though e.g., openings or cracks such as gap 188 that might not otherwise be captured by first trough 140. For this embodiment, second trough 158 is located vertically above rear window 192 formed by interior wall 124. More particularly, along vertical direction V, second trough 158 is located above the see-through portion 164 of panes 166, 168, and 170 along vertical direction V so as to prevent liquids from travelling downward onto panes 166, 168, or 170 of door 120. Second diverter 156 can be formed from a metal sheet having a bend 160 along its bottom edge that forms second trough 158.

As depicted in e.g., FIG. 8, second trough 158 extends longitudinally at a non-zero, acute angle θ from lateral direction L (i.e. from horizontal) so as to cause liquid in first trough 158 to flow towards side 132 of door 120. Other angles different from that depicted in the figures may be used and liquid could also be caused to flow towards opposing side 130. In other embodiments, first trough 158 could have one portion angled so that liquid flows towards one side 130 while another portion is angled to that liquid flows to the other side 132. Other constructions including a zero angle may be used provided liquid is directed away from the see-through portion 164 of front window 110 and rear window 192.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door for an oven appliance, the door defining vertical, lateral, and transverse directions, the door comprising:

an exterior wall;

an interior wall, the exterior wall and interior wall extending along the vertical direction between a top portion and a bottom portion of the door and extending along the lateral direction between opposing lateral sides of the door;

a cavity defined at least in part by the exterior wall and the interior wall and located therebetween;

ventilation ports positioned near the top of portion of the door;

a first diverter positioned within the cavity below the ventilation ports and adjacent to the exterior wall, the first diverter including a first trough extending longitudinally at a non-zero angle from the lateral direction so as to cause liquid to flow towards at least one of the opposing lateral sides of the door;

a deflector positioned within the cavity adjacent to the ventilation ports and above the first trough, the deflector spaced apart along the transverse direction from the exterior wall, the deflector having a lip angled towards the exterior wall so as to cause liquid to flow towards the exterior wall; and a second diverter positioned within the cavity below the ventilation ports and adjacent to the interior wall, the second diverter including a second trough extending longitudinally at a non-zero angle from the lateral direction so as to cause liquid to flow towards at least one of the opposing lateral sides of the door.

2. The door for an oven appliance as in claim 1, wherein the first diverter is attached to the exterior wall.

3. The door for an oven appliance as in claim 2, wherein the first diverter comprises a metal sheet having a bend along one edge so as to form the first trough.

4. The door for an oven appliance as in claim 2, wherein the second diverter is attached to the interior wall.

5. The door for an oven appliance as in claim 4, wherein the second diverter comprises a metal sheet having a bend along one edge so as to form the second trough.

6. The door for an oven appliance as in claim 5, wherein the diverter is attached to one of the opposing sides of the door.

7. The door for an oven appliance as in claim 1, wherein the ventilation ports are positioned on the exterior wall.

8. The door for an oven appliance as in claim 7, wherein the first diverter comprises a top edge positioned vertically below the ventilation ports.

9. The door for an oven appliance as in claim 1, wherein the lip of the deflector comprises a lip edge that is positioned directly over the first trough of the first diverter.

10. The door for an oven appliance as in claim 1, wherein the deflector comprises a top edge having a pair of attachment posts extending along the vertical direction.

11. The door for an oven appliance as in claim 1, further comprising a window having a see-through portion, and wherein the first trough, second trough, and lip are positioned above the see-through portion along the vertical direction.

12. An oven appliance, comprising:

a cook top surface including one or more heating elements positioned at the cook top surface;

a user interface panel positioned at the cook top surface;

an oven cavity for receipt of food items for cooking, the oven cavity positioned below the cook top surface a door defining vertical, lateral, and transverse directions, the door comprising an exterior wall and an interior wall spaced apart from each other along the transverse direction, the exterior wall defining ventilation ports positioned near a top portion of the door;

a first diverter positioned below the ventilation ports and adjacent to the exterior wall, the first diverter including a first trough extending longitudinally at a non-zero angle from the lateral direction so as to cause liquid to flow towards at least one of the opposing lateral sides of the door;

a deflector positioned adjacent to the ventilation ports and above the first trough, the deflector spaced apart along the transverse direction from the exterior wall, the deflector having a lip angled towards the exterior wall so as to cause liquid to flow towards the exterior wall; and a second diverter within the cavity below the ventilation ports and adjacent to the interior wall, the second diverter including a second trough extending at a non-zero angle from the lateral direction so as to cause liquid to flow towards at least one of the opposing lateral sides of the door.

13. The oven appliance as in claim 12, wherein the ventilation ports are positioned on the exterior wall.

14. The oven appliance as in claim 12, wherein the first diverter comprises a top edge positioned vertically below the ventilation ports, and wherein the first trough is positioned vertically higher than a see-through portion of the door.

15. The oven appliance as in claim 14, wherein the lip of the deflector comprises a lip edge that is positioned directly over the first trough of the first diverter.

16. The oven appliance as in claim 12, wherein the deflector comprises a top edge having a pair of attachment posts extending along the vertical direction.

17. The oven appliance as in claim 12, further comprising a window having a see-through portion, and wherein the first trough, second trough, and lip are positioned above the see-through portion along the vertical direction.

18. The oven appliance as in claim 17, wherein the first trough, the second trough, and the diverter are spaced apart from each other along the lateral direction.

* * * * *